US005697573A

United States Patent [19]

Fukuchi et al.

[11] Patent Number: 5,697,573

[45] Date of Patent: Dec. 16, 1997

[54] APPARATUS FOR STABLY TRANSFERRING BELT-LIKE MATERIAL

[75] Inventors: Junichi Fukuchi; Junji Ueno; Hisaki Tsumori; Toshikazu Yoshino, all of Tokyo, Japan

[73] Assignee: Japan Tobacco Inc., Tokyo, Japan

[21] Appl. No.: 591,297

[22] Filed: Jan. 25, 1996

[30] Foreign Application Priority Data

Jan. 26, 1995 [JP] Japan ..... 7-010598

[51] Int. Cl.[6] ..... B65H 23/04; B65H 35/04

[52] U.S. Cl. ..... 242/412.2; 242/413.5; 242/417.1

[58] Field of Search ..... 242/412.2, 413.5, 242/417.1, 420.2, 331.3, 525.4, 526.1

[56] References Cited

U.S. PATENT DOCUMENTS

| | | | |
|---|---|---|---|
| 3,203,635 | 8/1965 | Rayfield et al. | 242/412.2 |
| 3,223,338 | 12/1965 | Takeuchi | 242/331.3 |
| 3,785,588 | 1/1974 | Schramm | 242/412.2 |
| 4,025,005 | 5/1977 | Fleck et al. | 242/412.2 |
| 4,030,131 | 6/1977 | Beiter et al. | 242/412.2 |
| 4,377,251 | 3/1983 | Kinchelde et al. | 242/331.3 |
| 4,399,958 | 8/1983 | Dupont | 242/331.3 |
| 5,505,401 | 4/1996 | Lamothe | 242/412.2 |

*Primary Examiner*—John M. Jillions

[57] ABSTRACT

A belt-like material stably transferring apparatus an absorbing and feeding apparatus for continuously absorbing and feeding the belt-like material by use of a difference in air pressure. The absorbing and feeding apparatus comprises a reserving chamber for absorbing and feeding the belt-like material to be reserved therein, and a pressure detecting chamber connected to the reserving chamber through a slit. The reserving chamber has an opening portion for feeding the belt-like material, and blowers and are connected at a position, which is opposite to the opening portion. The pressure of the pressure detecting chamber is changed in accordance with the change of the pressure in the reserving chamber connected to the pressure detecting chamber through the slit. The pressure of the reserving chamber is changed in accordance with the amount of absorbing and feeding the belt-like material absorbed and fed to the reserving chamber. Due to this, the pressure of the pressure detecting chamber is detected by pressure detectors, thereby the amount of absorbing and feeding the belt-like material absorbed and fed to the reserving chamber is detected. The belt-like material stably transferring apparatus comprise analog cards for controlling the amount of supplying the belt-like material based on the amount of absorbed and fed belt-like material.

10 Claims, 6 Drawing Sheets

APPARATUS FOR STABLY TRANSFERRING BELT-LIKE MATERIAL

BACKGROUND OF THE INVENTION

1. Field of the Invention

The present invention relates to an apparatus for stably transferring belt-like material, and particularly to an apparatus for stably transferring belt-like material provided to a hole forming apparatus for forming fine holes on the belt-like material such as a chip paper of cigarette.

2. Description of the Related Art

Generally, an apparatus for processing belt-like material, for example, a hole forming apparatus for forming fine holes on the belt-like material, e.g., rolled chip paper comprises a belt-like material transferring apparatus for transferring chip paper. The hole forming apparatus comprises a supplying apparatus having a delivery roller for delivering rolled chip paper, a hole forming device for irradiating chip paper, which is delivered from the supplying apparatus to be transferred at predetermined speed, with a laser beam so as to form fine holes, a feed roller for transferring chip paper, which has fine holes formed by the hole forming apparatus, at fixed speed, a winding apparatus having a winding roller for winding transferred chip paper, a transfer passage having a plurality of rollers for continuously transferring the belt-like material from the supplying apparatus to the winding apparatus, a plurality of drive motors for driving each of the rollers, and a controlling apparatus for controlling the entire hole forming apparatus. The delivery roller, the feed roller, the winding roller, the transfer passage, and the drive motors function as the belt-like transferring apparatus for transferring the belt-like material such as chip paper.

The conventional hole forming apparatus comprises a tension detecting apparatus for detecting tension of chip paper to be transferred in order to stably deliver chip paper and wind the delivered chip paper. As an example, there is a tension detecting apparatus for detecting a diameter of roll wound around the winding roller to calculate tension of transferring chip paper. The controlling apparatus controls the drive of each motor based on the calculated tension of chip paper. In other words, the rotating speed of delivery roller and that of the winding roller are controlled, so that suitable braking force or driving force is applied to the delivery roller and the winding roller, and tension of belt-like material is controlled to be constantly maintained.

Moreover, there is a case in which a tension mechanism is provided as a apparatus for stably delivering or winding chip paper. The tension mechanism comprises a tension roller, which is provided between the delivery roller and the feed roller or between the feed roller and the winding roller, and which moves up and down by a spring. The tension mechanism relaxes a load applied to the transferring chip paper when the tension roller moves up and down.

Generally, in processing the belt-like material such as chip paper, it is regarded to be important to set the apparatus to a normal delivering state immediately chip paper is replaced with new one since waste of chip paper can be avoided and ability of production can be improved. Moreover, since chip paper is extremely thin and easily broken, careful treatment is required.

In the above-mentioned hole forming apparatus comprising the tension detecting apparatus or the tension mechanism, it is necessary to start the respective rollers substantially simultaneously at high speed in order to set the apparatus to the normal delivering state instantly. At the time of starting the apparatus, that is, at the time of starting the respective rollers, the respective rollers are started at high speed instantly, and extremely high tension is applied to chip paper and the feed roller. Due to this, there is possibility that chip paper will be broken.

Also, in a case where the chip paper is broken when the operation of the apparatus is started at high speed, the operations of a series of apparatus are stopped, and there is a problem in that a production efficiency is considerably lowered.

Moreover, at the time of stopping the operation of the apparatus, the apparatus is instantaneously stopped and brake force is abruptly applied to the transferring paper to be stopped. Due to this, high tension is applied to chip paper, and there is possibility that chip paper will be broken.

The above-mentioned problems may occurs in not only the apparatus for processing the belt-like material such as chip paper of cigarette but also an apparatus for printing or processing wrapping paper cut to a predetermined size.

SUMMARY OF THE INVENTION

An object of the present invention is to provide an apparatus for stably transferring belt-like material, which can be instantaneously started at high speed and stopped. Also, an object of the present invention is to provide a detector for ensuring a stable transfer of belt-like material.

According to a first aspect of the present invention, there is provided to an apparatus for stably transferring belt-like material comprising transferring means for transferring belt-like material; absorbing and feeding means, having a reserving chamber for reserving the transferred belt-like material, for applying a pressure difference to first and second spaces of the reserving chamber divided by the transferred belt-like material so as to absorb and feed the belt-like material to the reserving chamber; detecting means for detecting an extending position of the belt-like material moving up or down in the reserving chamber; and controlling means for controlling the transferring means in accordance with an output detected by the detecting means so as to adjust a transferring speed of the belt-like material.

According to a second aspect of the present invention, there is provided to an apparatus for stably transferring belt-like material comprising supplying means for supplying belt-like material; absorbing and feeding means having a reserving chamber for continuously absorbing and feeding the belt-like material supplied from the supplying means, and a pressure detecting chamber, provided at the back of the reserving chamber through a through hole, and closed to detect its internal pressure; transferring means for pulling out the belt-like material absorbed and fed to the reserving chamber of the absorbing and feeding means so as to be transferred; pressure converting means, connected to the pressure detecting chamber of the absorbing and feeding means, for detecting the internal pressure of the pressure detecting chamber changing in accordance with the amount of absorbing and feeding the belt-like material absorbed and fed to the reserving chamber so as to convert the detected internal pressure to an electrical signal; and controlling means for decreasing the amount of supply of the belt-like material supplied by the supplying means when the amount of absorbing and feeding the belt-like material is large, and for increasing the amount of supply of the belt-like material supplied by the supplying means when the amount of absorbing and feeding the belt-like material is small based on the electrical signal converted by the pressure converting means.

According to a third aspect of the present invention, there is provided to an apparatus for stably transferring belt-like material comprising: supplying means for supplying belt-like material; first absorbing and feeding means having a reserving chamber for continuously absorbing and feeding the belt-like material supplied from the supplying means, and a pressure detecting chamber, provided at the back of the reserving chamber through a through hole, and closed to detect its internal pressure; transferring means for pulling out the belt-like material absorbed and fed to the reserving chamber of the first absorbing and feeding means so as to be transferred; first pressure converting means, connected to the pressure detecting chamber of the first absorbing and feeding means, for detecting the internal pressure of the pressure detecting chamber changing in accordance with the amount of absorbing and feeding belt-like material absorbed and fed to the reserving chamber so as to convert the detected internal pressure to an electrical signal; supply controlling means for controlling the amount of supply of the belt-like material supplied by supplying means based on the electrical signal converted by the first pressure converting means; second absorbing and feeding means having a reserving chamber for continuously absorbing and feeding the belt-like material transferred from the transferring means, and a pressure detecting chamber, provided at the back of the reserving chamber through a through hole, and closed to detect its internal pressure; receiving means for receiving the belt-like material transferred to the reserving chamber of the second absorbing and feeding means; second pressure converting means, connected to the pressure detecting chamber of the second absorbing and feeding means, for detecting the internal pressure of the pressure detecting chamber changing in accordance with the amount of absorbing and feeding the belt-like material absorbed and fed to the reserving chamber so as to convert the detected internal pressure to an electrical signal; and receiving controlling means for controlling the amount of receiving of the belt-like material received form the receiving means based on the electrical signal converted by the second pressure converting means.

According to a fourth aspect of the present invention, there is provided to an apparatus for detecting an amount of absorbed and fed belt-like material comprising first case means, having an opening portion, for defining a reserving chamber; belt-like material, transferred to the reserving chamber through the opening portion, for dividing the reserving chamber to first and second spaces; second case means, communicated with the reserving chamber through a fine communicating hole, for defining a pressure detecting chamber; absorbing and feeding means for applying negative pressure to the second space of the reserving chamber so as to absorb and feed the belt-like material; and detecting means for detecting pressure of the pressure detecting chamber changing in accordance with an amount of absorbing and feeding the belt-like material.

According to the present invention, due to control the amount of supplying the belt-like material, and the amount of receiving the belt-like material, the operation of the apparatus can be instantaneously started or stopped at high speed without applying high load to the feed roller regardless of the size of the roll diameter of the belt-like material. Such control is performed based on the internal pressure of the pressure detecting chamber changing in accordance with the amount of absorbing and feeding the belt-like material to the reserving chamber of the absorbing and feeding means, that is, the length, which is from the upper end portion of the reserving chamber to the lowermost end position of the absorbed and fed belt-like material. Moreover, since the operation of the apparatus can be instantaneously started or stopped at high speed without applying high load to the belt-like material, the breakage of the belt-like material can be prevented. Due to this, the apparatus can be prevented from being undesirably stopped by the breakage of the belt-like material, thereby the ability of processing the belt-like material can be improved.

Also, according to the present invention, the belt-like material is transferred to the reserving chamber through the opening portion of the reserving chamber so as to divide the reserving chamber to first and second spaces. By applying negative pressure to the second space, a pressure difference between the first and second spaces of the reserving chamber is generated. Then, the internal pressure of the pressure detecting chamber, which communicates with the reserving chamber through the fine communicating hole, is changed in accordance with the amount of absorbing and feeding the belt-like material. Therefore, the pressure change of the pressure detecting chamber is detected, thereby the amount of absorbing and feeding the belt-like material can be correctly detected.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENT

With reference to the drawings, the following will specifically explain an embodiment of an apparatus for stably transferring belt-like material of the present invention, which is provided in, for example, a hole forming apparatus for forming fine holes in the belt-like material such as chip paper of cigarette.

Figure 1:
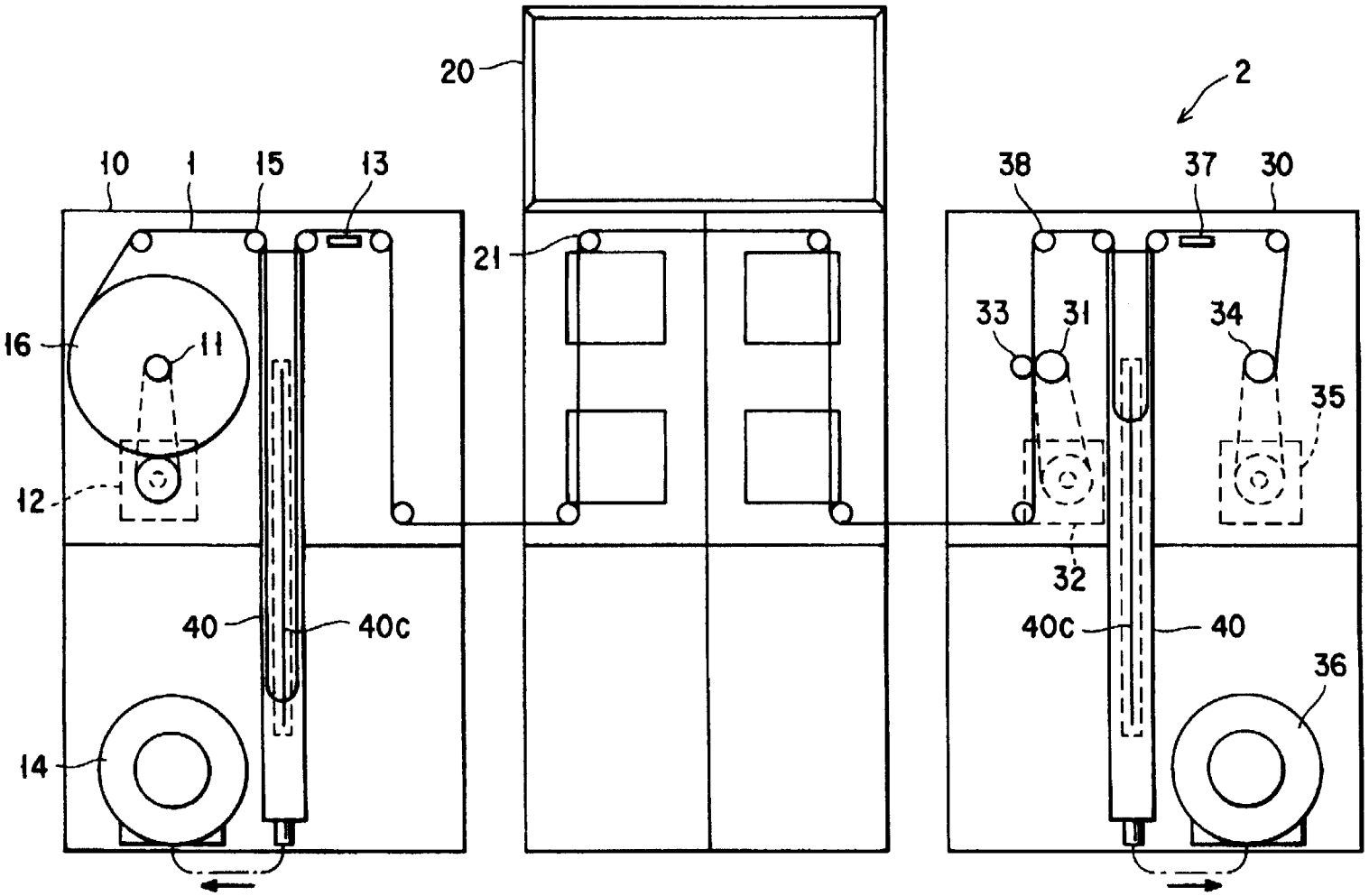
FIG. 1 is a front view schematically showing a punching apparatus having an apparatus for stably transferring belt-like material.

FIG. 1 is a front view schematically showing a hole forming apparatus having an apparatus for stably transferring belt-like material. As shown in FIG. 1, a punching apparatus 2 comprises a supplying apparatus 10 for delivering belt-like material, e.g., chip paper 16 wound in a roll form, a hole forming apparatus 20 for forming fine holes in chip paper delivered from the supplying apparatus; and a winding apparatus 30 for winding chip paper 1 in which holes are formed by the hole forming device 20. Moreover, the winding apparatus 30 comprises a feed roller 31 to be described later. The feed roller 31 draws chip paper 1 from the supplying apparatus 10 to be transferred to the winding apparatus 30 through the hole forming device 20. Furthermore, between the supplying apparatus 10 and the winding apparatus 30, there is provided a transferring passage, which is formed of a plurality of rollers, to transfer chip paper.

The supplying apparatus 10 comprises a delivery roller 11 to which the rolled chip paper 16 is attached, a servo motor 12 for driving the delivery roller at a predetermined rotating speed, a brake device 13 for adjusting tension of chip paper 1 delivered from the rolled chip paper 16 attached on the delivery roller 11, a blower 14 for absorbing the delivered chip paper 1, an absorbing and feeding apparatus 40 for continuously absorbing and feeding chip paper 1 when the blower 14 absorbs chip paper 1, and a transferring passage 15 formed of a plurality of rollers.

Chip paper 1 is mainly pulled out from the rolled chip paper 16 by a feed roller 31 provided in the winding apparatus 30. The servo motor 12 for driving the delivery roller 11 is controlled in accordance with an amount of reserved chip paper 1 of the absorbing and feeding apparatus 40 on the supplying apparatus 10. In other words, the apparatus for stably transferring belt-like material on the supplying apparatus 10 comprises the feed roller 31 functioning as a main roller, the delivery roller 11 functioning as a follow roller, the transferring passage 15 where chip paper is transferred, and the absorbing and feeding apparatus 40 for continuously absorbing and feeding chip paper.

The delivery roller 11 provided in the supplying apparatus 10 has a bobbin holder, and a rotational shaft on which the bobbin holder is fixed. In the bobbin holder, a delivery bobbin having chip paper 1 as belt-like material wound in the roll form is detachably provided. The delivery bobbin is mounted on the rotational shaft of the delivery roller 11, and the shaft is rotated, so that chip paper 1 is delivered to the transferring passage 15. The servo motor 12 drives the delivery roller 11 which is controlled at a predetermined rotating speed based on a control signal output from a control system to be described later. Moreover, there is provided the brake device 13 in the transferring passage 15 to adjust tension of chip paper 1 delivered from the rolled chip paper 16. The brake device 13 has a plurality of absorbing holes along the surface where chip paper 1 is passed. By absorbing force generated at these absorbing holes, chip paper 1 is absorbed. Thereby, brake force is applied to the delivering chip paper 1, and tension of chip paper 1 is adjusted by changing absorbing force.

Figure 2:
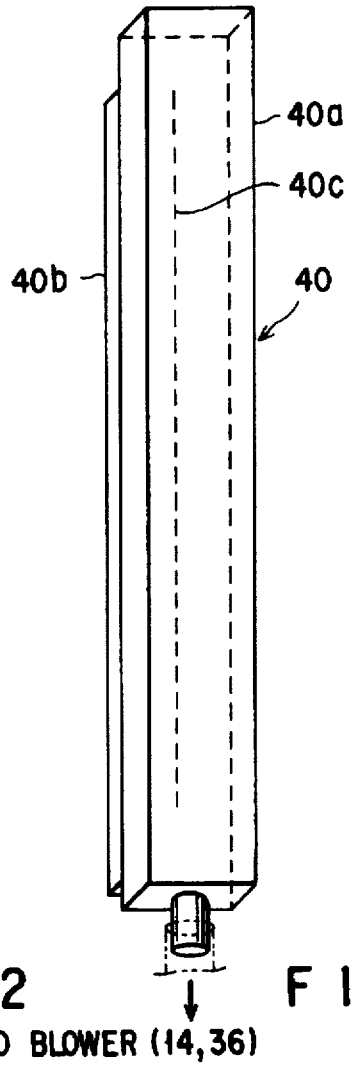
FIG. 2 is a schematic perspective view of a belt-like material absorbing and feeding apparatus, which is provided to a supplying apparatus of the punching apparatus of FIG. 1, and a winding apparatus, seen from a front side.
Figure 3:
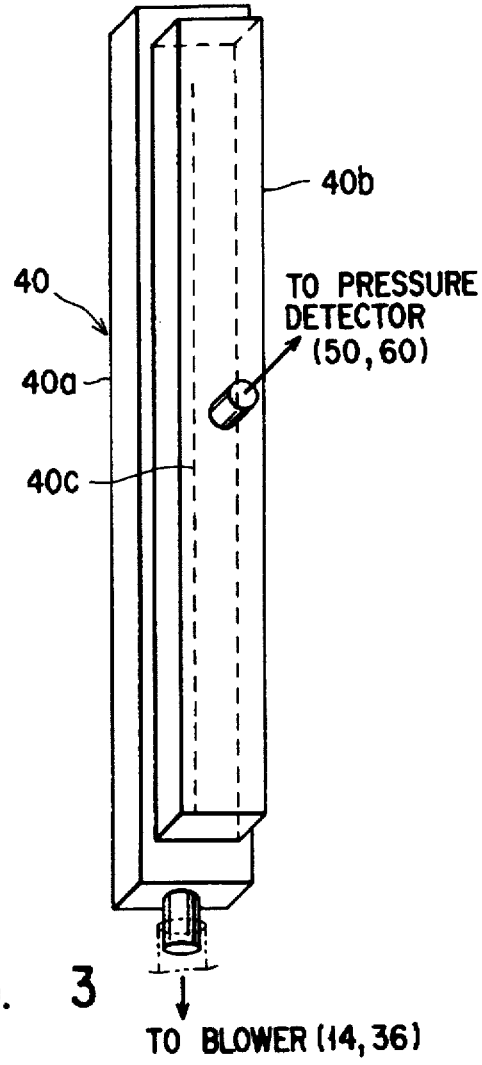
FIG. 3 is a schematic perspective view of the belt-like material absorbing and feeding apparatus of FIG. 2, seen from a back side.

The absorbing and feeding apparatus 40, which is provided between the delivery roller 11 and the brake apparatus 13, comprises a box-type reserving chamber 40*a* and a pressure detecting chamber 40*b* as shown in FIGS. 2 and 3. In the pressure detecting chamber 40*b*, which is provided at the back of the absorbing and feeding apparatus 40, pressure of the interior is detected by a detector to be described later. An upper portion of the reserving chamber 40*a* is opened such that delivered chip paper 1 can be absorbed. The bottom of the reserving chamber 40*a* is connected to the blower 14 for absorbing air of the reserving chamber 40*a* by predetermined absorbing force. In the other words, the reserving chamber 40*a* and the pressure detecting chamber 40*b* are formed as one unit through a slit 40*c*. The pressure detecting chamber 40*b* is connected to a pressure detector 50 for detecting internal pressure of the pressure detecting chamber 40*b*. Also, surfaces other than the surface having the slit 40*c* are closed.

Particularly, by absorbing air in the reserving chamber 40*a* of the absorbing and feeding apparatus 40, chip paper 1, which is inserted in the reserving chamber 40*a* from the opening of the upper portion of the reserving chamber 40*a* in advance, is absorbed and fed to the bottom portion to which the blower 14 is connected. In other words, air of the space, which is from the inserted chip paper 1 to a place close to the lower portion of the reserving chamber to which the blower 14 is connected, is positively absorbed by the blower 14, and results in obtaining pressure close to vacuum. On the other hand, air, which is from the inserted chip paper to a place close to the opening of the reserving chamber, is maintained to be pressure close to atmospheric pressure. Therefore, by pressure difference acting on chip paper 1 inserted in the reserving chamber, chip paper 1 is absorbed and fed to the lower portion of the reserving chamber 40*a* to which the blower 14 is connected.

Chip paper 1 absorbed and fed to the reserving chamber 40*a* is pulled outside from the reserving chamber 40*a* by the feed roller 31. When chip paper 1, which is delivered when the delivery roller 11 is rotated, is passed the upper portion of the reserving chamber 40*a*, chip paper 1 is absorbed by the blower 14 to be continuously absorbed and fed to the reserving chamber 40*a*. At the same time, the feed roller 31 continuously pulls chip paper 1, which is absorbed and fed to the reserving chamber 40*a*, outside from the reserving chamber 40*a*.

As mentioned above, the delivery roller 11 and the feed roller 31 are driven, so that chip paper 1 is continuously absorbed and fed, and pulled outside from the reserving chamber. Here, a length of chip paper 1, which is from an uppermost end portion of the reserving chamber to a lowermost end portion, is hereinafter called amount of absorbing and feeding the chip paper.

The internal pressure of the pressure detecting chamber 40b is changed in accordance with the amount of absorbing and feeding chip paper 1 absorbed and fed to the reserving chamber 40a. Due to this, the internal pressure of the pressure detecting chamber 40b is detected by the pressure detector 50, thereby the amount of absorbing and feeding chip paper 1 can be detected. The rotating speed of the servo motor 12 for driving the delivery roller 11 is controlled in accordance with the amount of absorbing and feeding the chip paper 1 as described later.

The slit 40c is formed such that air of the resereserving chamber 40a and that of the pressure detecting chamber 40b can be ventilated. If the slit can achieve the above function, the slit may be linearly arranged. The shape of the reserving chamber is not limited to the box type. Any shapes may be used if the reserving chamber is shaped such that the belt-like material can be smoothly absorbed and fed, and pulled out.

As mentioned above, chip paper 1 delivered from the rolled chip paper 16 attached to the delivery roller 11 is continuously absorbed and fed to the reserving chamber by absorbing force of the blower 14 from the opening of the reserving chamber 40a of the absorbing and feeding apparatus 40, and pulled out of the opening by the feed roller 31. Thereby, the load, which is applied to chip paper 1 when the apparatus is instantaneously started or stopped, is relaxed. Due to this, the apparatus can be instantaneously started or stopped without applying high load to chip paper itself. Also, chip paper 1 can be prevented from being broken when the apparatus is instantaneously started or stopped.

The hole forming apparatus 20 comprises a laser apparatus for providing hole formation processing by irradiating the transferring chip paper 1 with a laser beam, a laser driving apparatus for driving the laser apparatus, an optical system for guiding the laser beam irradiated from the laser apparatus to a predetermined place, and a transferring passage 21, which is formed of a plurality of rollers.

In the hole forming apparatus 20, there are provided the laser apparatus (not shown) and the optical system such as a polygon mirror, a half-mirror, and a reflecting mirror. As the laser apparatus, high energy laser such as carbon dioxide laser is used. The laser beam, which is continuously emitted from the laser apparatus, is guided to the half-mirror through the polygon mirror, and divided to a plurality of pulse beams. For example, four divided pulse laser beams are arranged in four lines by the reflecting mirror provided at a predetermined position, and guided to chip paper transferring on the transferring passage 21. Chip paper 1 is irradiated with the four lined laser beams, thereby fine holes are formed on chip paper 1 in four lines having a fixed distance. Therefore, the hole formation of chip paper 1 is efficiently processed.

The winding apparatus 30 comprises a feed roller 31 for transferring chip paper 1, a servo motor 32 for driving the feed roller 31 at a predetermined rotating speed, a winding roller 34 for winding chip paper 1 transferred by the feed roller 31 in a roll form, a servo motor 35 for driving the winding roller 34 at a predetermined rotating speed, a blower 36 for absorbing chip paper 1 transferred by the feed roller 31, the absorbing and feeding apparatus 40 for continuously absorbing and feeding chip paper 1 when the blower 36 absorbs chip paper 1, a brake apparatus 37 for adjusting tension of chip paper wound by the winding roller 34, and a transferring passage 38 formed of a plurality of rollers.

The winding roller 34 has a bobbin holder, and a rotational shaft on which the bobbin holder is fixed. In the bobbin holder, a winding bobbin for winding chip paper 1 in the roll form is detachably provided.

As explained above, chip paper 1 is pulled out of the absorbing and feeding apparatus 40 on the supplying apparatus 10 by the feed roller 31, and transferred to the winding apparatus 30. Also, the servo motor 35 for driving the winding roller 34 is controlled to be driven at a predetermined rotating speed in accordance with an amount of absorbing and feeding chip paper in the absorbing and feeding apparatus 40 provided in the winding apparatus 30. In other words, the apparatus for stably transferring belt-like material on the winding apparatus 30 comprises the feed roller 31 functioning as a main roller for transferring chip paper as belt-like material, the winding roller 34 functioning as a follow roller, the transferring passage 38 where chip paper is transferred, and the absorbing and feeding apparatus 40 for continuously absorbing and feeding the chip paper 1.

A rubber roller 33 is provided to be freely rotatable at a position opposite to the feed roller 31 provided to transfer chip paper 1. The feed roller 31 is rotated at a predetermined rotating speed by the servo motor 32. While the rubber roller 33 is pressurized by the feed roller 31, the chip paper 1 is transferred at fixed speed. At the time of stopping the transfer of chip paper 1, the rubber roller 33 is separated from the feed roller 31. At the time of starting the transfer of chip paper 1, the rubber roller 33 is pressurized by feed roller 31.

As already explained with reference to FIGS. 2 and 3, the absorbing and feeding apparatus 40 has the box-typed reserving chamber 40a and the pressure detecting chamber 40b. The upper portion of the reserving chamber 40a is opened. The blower 36 is connected to the bottom portion of the reserving chamber 40a. A pressure detector 60 is connected to the pressure detecting chamber 40b. The internal pressure of the pressure detecting chamber 40b is detected by the pressure detector 60. The internal pressure of the pressure detecting chamber 40b is changed in accordance with the amount of absorbing and feeding the chip paper 1. The rotating speed of the servo motor 35 for driving the winding roller 34 is controlled in accordance with the amount of absorbing and feeding the chip paper 1 as described later.

In the transferring passage 38 between the feed roller 31 and the winding roller 34, there is provided the brake apparatus 37 for adjusting tension of chip paper wound by the winding roller 34. The brake device 37 has a plurality of absorbing holes along the surface where chip page 1 is passed. By absorbing force generated at these absorbing holes, braking force is applied to the chip paper 1. Then, tension of the chip paper 1 is adjusted by changing absorbing force.

The winding bobbin for winding chip paper 1 in the roll form is provided to the rotational shaft of the winding roller 34. When the feed roller 31 is driven, thereby the chip paper 1 transferred from the supplying apparatus 10 is further transferred to the winding apparatus 30. The chip paper 1 transferred by the feed roller 31 is continuously absorbed and fed to the reserving chamber from the opening of the reserving chamber 40a of the absorbing and feeding apparatus 40 on the side of the winding apparatus 30. Then, when the rotational shaft of the winding roller 34 is rotated, thereby chip paper 1 absorbed and fed to the reserving chamber 40a is continuously pulled out of the opening of the reserving chamber 40a. Thereafter, the chip paper 1 is wound around the winding bobbin. At this time, the servo motor 35 for driving the winding roller 34 is controlled based on a control signal sent from a control system to be described later, so that the winding roller 34 is driven at a predetermined rotating speed.

As mentioned above, chip paper 1 supplied from the feed roller 31 is continuously absorbed and fed to the reserving chamber by absorbing force of the blower 36 from the opening of the reserving chamber 40*a* of the absorbing and feeding apparatus 40, and pulled out of the opening by the winding roller 34. Thereby, the load, which is applied to the feed roller 31 and the chip paper 1 when the apparatus is instantaneously started or stopped, is relaxed. Due to this, the apparatus can be instantaneously started or stopped without applying high load to chip paper itself. Also, the chip paper 1 can be prevented from being broken when the apparatus is instantaneously started or stopped.

The following will explain an operation of the punching apparatus 2 having the apparatus for stably transferring belt-like material of the present invention with reference to FIG. 1.

Prior to power supply of the apparatus, the chip paper is provided in the apparatus in advance as mentioned below and an operation of the apparatus is prepared.

More specifically, the delivery bobbin of rolled chip paper 16 is attached to the rotatable shaft of the deliver roller 11 provided to the supplying apparatus 10. The rolled chip paper 16 is partially pulled out of the rolled chip paper 16 attached to the rotatable shaft of the delivery roller 11 by an operator. Thereby, the rolled paper 16 is positioned on the opening of the reserving chamber 40*a* on the side of the supplying apparatus 10 through the transferring passage 15. The chip paper 1 is placed along the transferring passage 38 of the side of the winding apparatus 30 through the transferring passage 21 of the hole forming apparatus 20. In other words, the chip paper 1 is passed through the portion between the feed roller 31 and the rubber roller 33, and positioned on the opening of the reserving chamber 40*a* on the side of the winding apparatus 30 so as to be fixed to the bobbin of the winding roller 34. In such a preparation process, in consideration of the point that the chip paper 1 is absorbed and fed to the reserving chamber 40*a* in a U shape later, the chip paper 1 is pulled out extra in advance. Then, the chip paper 1 is inserted in each reserving chamber 40*a* by a predetermined length. After the chip paper is provided in the apparatus 2, the rubber roller 31 comes in contact with the feed roller 31 through the chip paper, so that the chip paper 1 is held.

After the above-mentioned preparation, power of the blowers 14 and 36 are turned on, and chip paper 1, which is inserted in the reserving chamber 40*a* of each of the supplying apparatus 10 and the winding apparatus 30, is started to be absorbed. By the above absorption, a predetermined amount of chip paper 1 is absorbed and fed to the reserving chamber 40*a* of each of the supplying apparatus 10 and the winding apparatus 30 in a U shape to be reserved therein. Normally, when power of the blower 14 and 36 are turned on, the amount of absorbing and feeding the chip paper is set to be large in the reserving chamber on the side of the delivery apparatus 10, so that chip paper is absorbed and fed to the place relatively close to the bottom portion. At this time, the amount of absorbing and feeding the chip paper is set to be small in the reserving chamber on the side of the winding apparatus 30, so that the chip paper is absorbed and fed to the place relatively close to the upper portion.

Next, main power of the apparatus 2 is turned on, the operation of the apparatus 2 is started. More specifically, the servo motors 12, 32, and 35 for driving the delivery roller 11, the feed roller 31, and the winding roller 34, respectively are started to be operated at substantially the same time, so that the rollers 11, 31, and 34 are instantaneously rotated at high speed. By the rotation of the delivery roller 11, chip paper 1 is continuously delivered from the rolled chip paper 16. By the rotation of the feed roller 31, chip paper 1 is delivered on the transferring passage 15. Chip paper 1 to be passed through the place close to the upper portion of the absorbing and feeding apparatus 40 is continuously absorbed and fed to the reserving chamber 40*a* of the absorbing and feeding apparatus 40 by absorbing force of the blower 14 connected to the bottom of the absorbing and feeding apparatus 40. The chip paper 1 absorbed and fed to the reserving chamber 40*a* is pulled outside from the reserving chamber 40*a* by the feed roller 31. The pulled chip paper 1 is transferred onto the transferring passage 15 to be supplied to the hole forming apparatus 20. Tension of the chip paper 1 is substantially constantly maintained by the brake apparatus 13 provided in the transferring passage 15.

The chip paper 1 supplied to the hole forming apparatus 20 is processed such that holes are formed while the chip paper 1 is transferring onto the transferring passage 21. In other words, the pulse laser beam emitted from the laser apparatus provided in the hole forming apparatus 20 is guided to chip paper 1, which is transferring onto the transferring passage 21, by the optical system. As a result, the chip paper 1 is processed such that holes are formed with a fixed distance. Then, chip paper 1 having holes is further transferred onto the transferring passage 21 to be supplied to the winding apparatus 30.

By the rotation of the feed roller 31, and that of the rubber roller 33, which comes in contact with the feed roller 31, the chip paper 1 is continuously delivered on the transferring passage 38. Then, the chip paper 1 to be passed through the place close to the upper portion of the absorbing and feeding apparatus 40 is continuously absorbed and fed to the reserving chamber 40*a* of the absorbing and feeding apparatus 40 by absorbing force of the blower 36 connected to the bottom of the absorbing and feeding apparatus 40. The chip paper 1 absorbed and fed to the reserving chamber 40*a* is pulled outside from the reserving chamber 40*a* by the rotation of the winding roller 34. The pulled chip paper 1 is transferred onto the transferring passage 38 to be wound by the winding roller 34 in which the winding bobbin is provided. Tension of the chip paper 1, which is being transferred onto the transferring passage 38, is substantially constantly maintained by the brake apparatus 37.

Next, the following will explain a method for controlling the rotating speed of the delivery roller 11 with reference to FIGS. 4 to 7.

Figure 4:
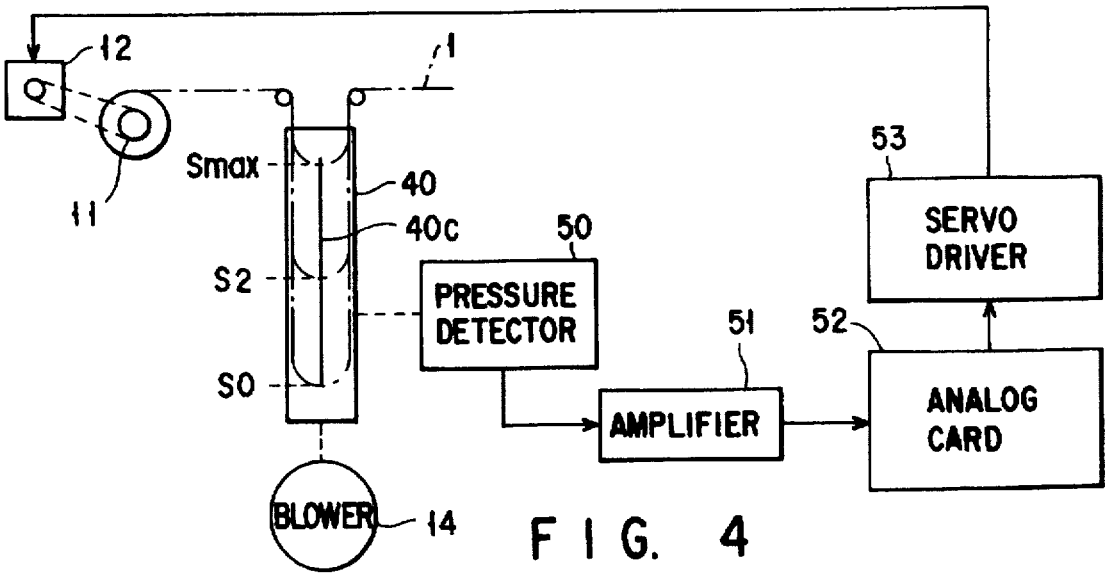
FIG. 4 is a block diagram schematically showing a control system for controlling the rotating speed of a delivery roller provided in the supplying apparatus.

As shown in FIG. 4, if the blower 14 absorbs air of the absorbing and feeding apparatus 40, chip paper 1, which is delivered from the rolled chip paper 16 provided to the delivery roller 11, is absorbed and fed in the reserving chamber 40*a* of the absorbing and feeding apparatus 40.

At this time, a length, which is from the position of the slit 40*c* closest to the blower, that is, the deepest position of the slit 40*c*, to the lowermost end portion of chip paper 1 absorbed and fed to the reserving chamber 40*a*, corresponds to the position of the slit 40*c* where the lowermost end portion of chip paper 1 is placed. Then, the length is hereinafter called as a slit position S. The position where the lowermost end portion of the chip paper 1 is placed at the deepest position of the slit 40*c* is S0, and the position where the lowermost end portion of chip paper 1 is placed at the uppermost position of the slit 40*c* is Smax.

The internal pressure of the pressure detecting chamber 40b provided at the back of the reserving chamber 40a is changed in accordance with the slit position S0 to Smax where the lowermost end portion of chip paper 1 is placed. The change of pressure is detected by the pressure detector 50 connected to the pressure detecting chamber 40b, and a difference between the above pressure and atmospheric pressure is converted to a voltage. The voltage is input to an amplifier 51 to be amplified. In this case, the voltage, which is obtained when the lowermost end portion of chip paper 1 is placed at the deepest position S0, is amplified to a motor supplying voltage value by which the rotating speed of the servo motor 12 for driving the delivery roller 11 is the lowest. The voltage amplified by the amplifier 51 is input to an analog card 52.

Figure 5:
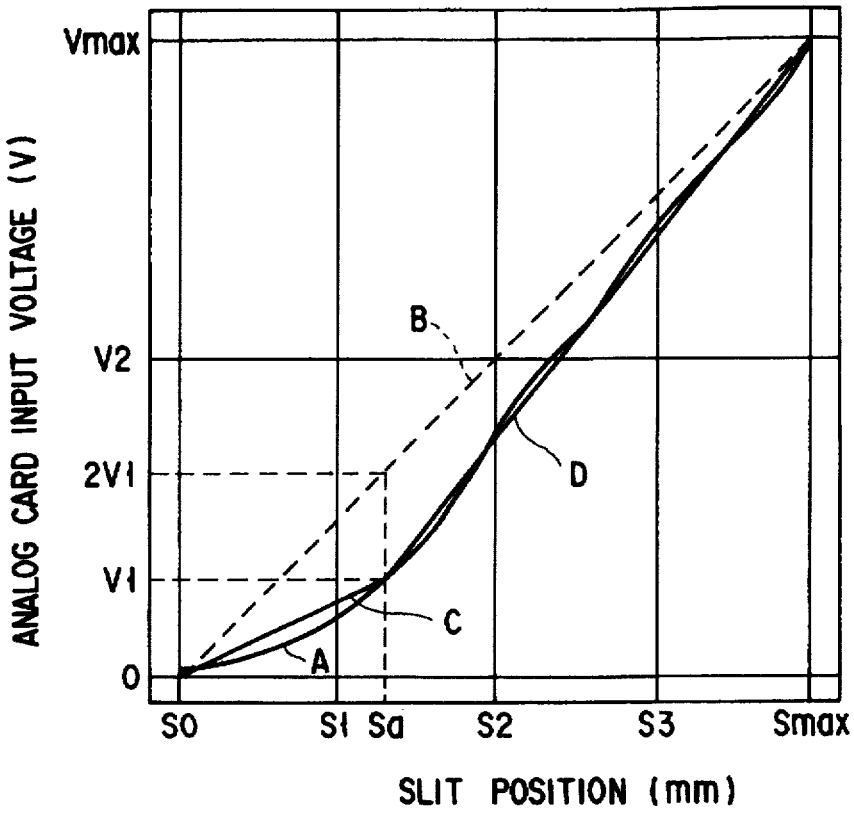
FIG. 5 is experimental data showing the relationship between a slit position of the belt-like material and an analog card input voltage in the belt-like material absorbing and feeding apparatus on the side of the supplying apparatus of FIG. 4.

FIG. 5 is a graph showing the relationship between the slit position where the lowest end portion of chip paper 1 is positioned and the voltage value amplified by the amplifier 51, that is, the analog card input voltage.

The analog card 52 is a control circuit for approximately converting a non-linear function to a linear function. The conversion to the linear function is performed by the following step based on the graph of FIG. 5.

More specifically, in order to convert experimental data showing the relationship between the slit position and the analog card input voltage, that is, a non-linear function A to a linear function B, the non-linear function A is approximated by two straight lines C and D. Then, the analog card input voltage value at the crossing point between two approximate straight lines C and D is corrected so as to correspond to the analog card input voltage of the linear function B at the same slit position. In this embodiment, the analog card input voltage value V1 at the crossing point between two straight lines C and D is corrected to the voltage value, e.g., 2V1, corresponding to the analog card input voltage of the linear function B at the same slit position Sa.

Figure 6:
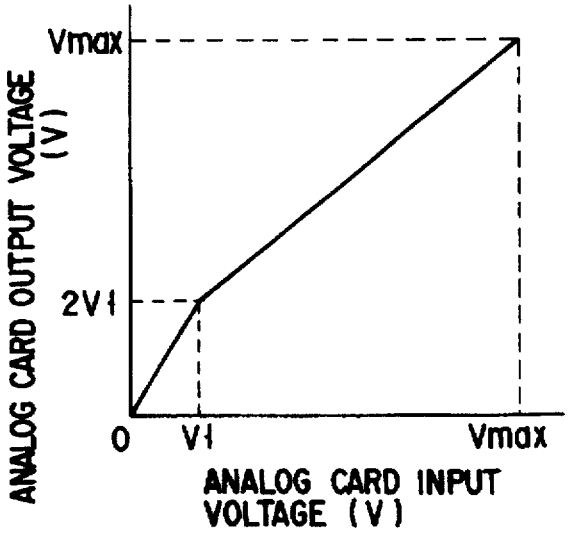
FIG. 6 is a graph showing the relationship between the analog card input voltage and an analog card output voltage on the side of the supplying apparatus of FIG. 4.

FIG. 6 is a graph showing the relationship between the analog card input voltage input from the amplifier 51 and an analog card output voltage, which is corrected by the analog card 52 and which is output to a servo driver 53. The analog card input voltage is converted to the analog card output voltage based on the relationship of FIG. 6.

Figure 7:
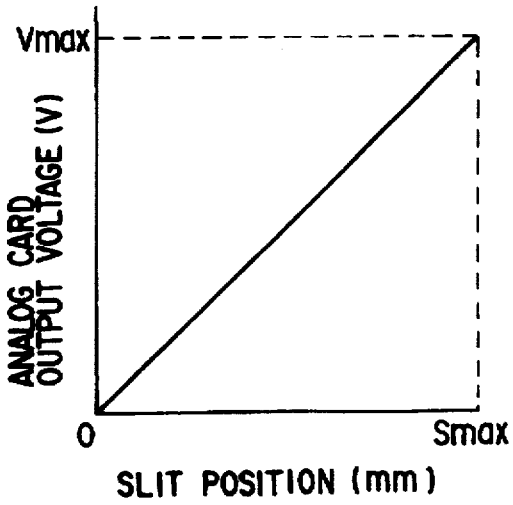
FIG. 7 is a graph showing the relationship between the corrected slit position and the analog card output voltage on the side of the supplying apparatus.

FIG. 7 is a graph showing the relationship between the slit position of chip paper and the analog card output voltage converted based on the relationship of FIG. 6. As shown in FIG. 7, the analog card output voltage, which corresponds to the slit position of chip paper, is converted to the linear function.

Then, the analog card output voltage, which is converted based on the slit position of chip paper, is output to the servo driver 53.

As mentioned above, the analog card input voltage value, which has the non-linear relationship with the slit position of the reserving chamber 40a of chip paper 1, is approximated by two straight lines, and corrected based on the relationship shown in FIG. 6. As a result, two approximate straight lines C and D are converted to one linear function B, so that the analog card output voltage shown in FIG. 7 can be obtained. The voltage output from the analog card 52 is input to the servo driver 53 for driving the servo motor 12. The rotating speed of the servo motor 12 is controlled in accordance with the output voltage. Then, in accordance with the rotating speed of the servo motor 12, the delivery roller 11 is rotated at a predetermined rotating speed, so that chip paper 1 is delivered from the rolled chip paper 16.

In other words, as shown in FIG. 7, if the amount of absorbing and feeding the chip paper 1 in the reserving chamber is large, that is, the slit position of chip paper 1 is low, the output voltage of the analog card is low, and the rotating speed of the servo motor 12 is reduced. Therefore, the amount of the delivery of chip paper 1 from the delivery roller 11 is reduced, so that the slit position rises. On the other hand, if the amount of absorbing and feeding chip paper 1 in the reserving chamber is small, that is, the slit position of chip paper 1 is high, the output voltage of the analog card is increased, and the rotating speed of the servo motor 12 is increased. Therefore, the amount of the delivery of chip paper 1 from the delivery roller 11 is increased, so that the slit position is lowered.

In the above-mentioned control system, the rotating speed of the delivery roller 11 can be controlled in accordance with the amount of absorbing and feeding the chip paper 1 in the reserving chamber regardless of the diameter of the roll of the rolled chip paper from which chip paper is delivered. Moreover, the apparatus can be instantaneously started and stopped without applying high load to chip paper 1.

Next, the following will explain a method for controlling the rotating speed of the winding roller 34 with reference to FIGS. 8 to 13.

Figure 8:
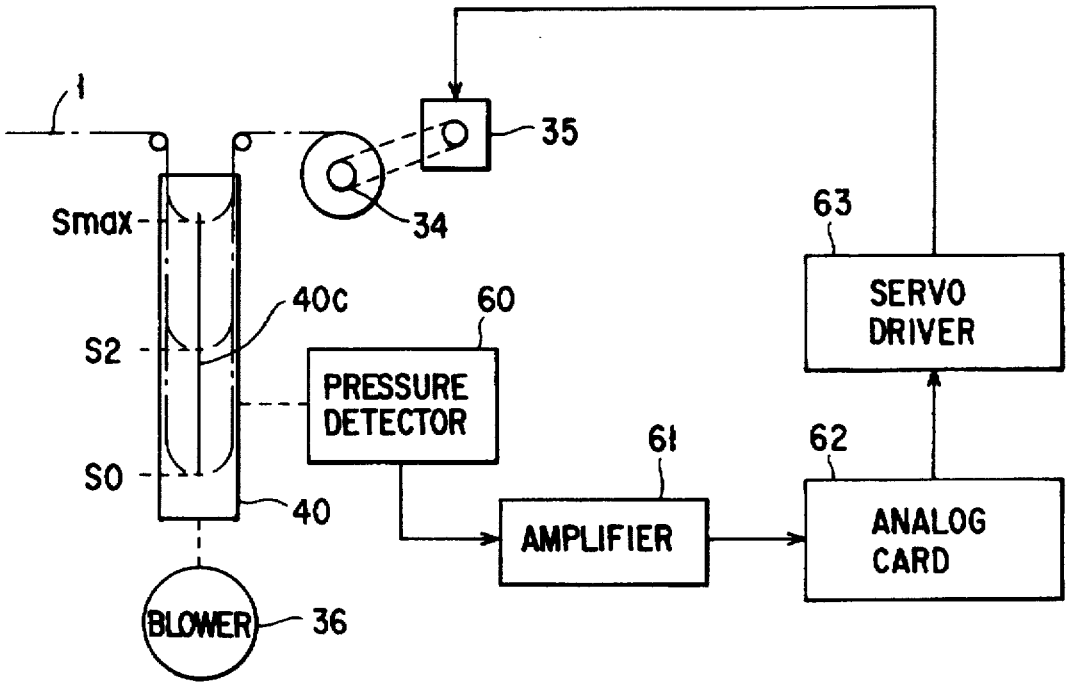
FIG. 8 is a block diagram schematically showing a control system for controlling the rotating speed of a winding roller provided in a winding apparatus.

As shown in FIG. 8, if the blower 36 absorbs air of the absorbing and feeding apparatus 40, chip paper 1, which is wound around the winding bobbin of the winding roller 34, is absorbed and fed in the reserving chamber 40a of the absorbing and feeding apparatus 40.

At this time, the internal pressure of the pressure detecting chamber 40b provided at the back of the reserving chamber 40a is changed in accordance with the slit position S0 to Smax of chip paper 1 absorbed and fed in the reserving chamber 40a. The change of pressure is detected by the pressure detector 60 connected to the pressure detecting chamber 40b, and a difference between the above pressure and atmospheric pressure is converted to a voltage. The voltage is input to an amplifier 61 to be amplified. In this case, the voltage, which is obtained when the lowermost end portion of chip paper 1 is placed at the deepest position S0, is amplified to a motor supplying voltage value by which the rotating speed of the servo motor 35 for driving the winding roller is the highest. The voltage amplified by the amplifier 61 is input to an analog card 62.

Figure 9:
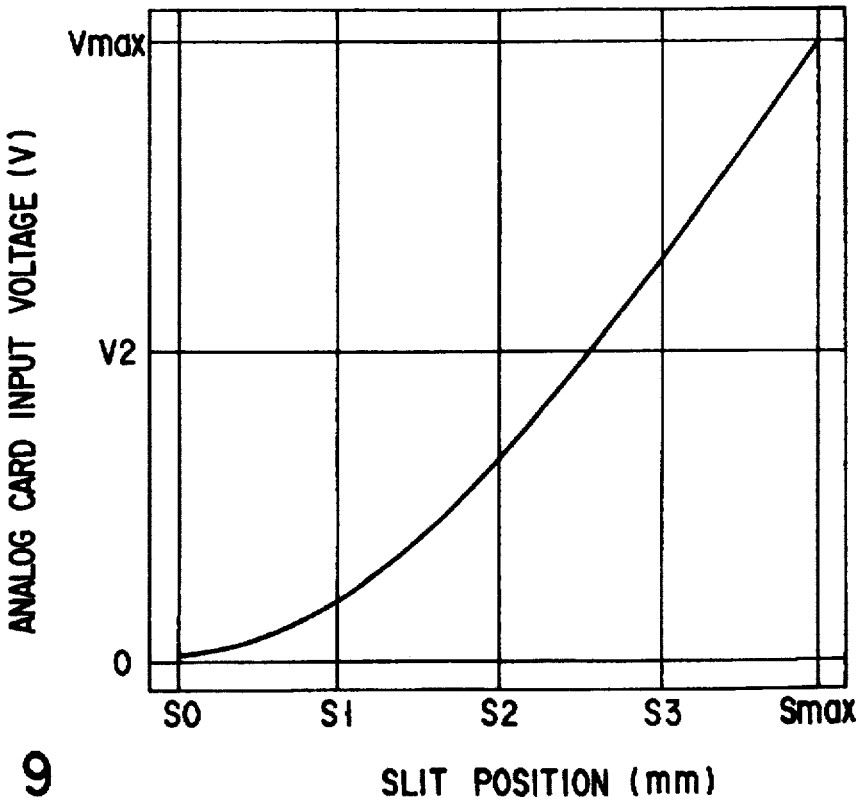
FIG. 9 is experimental data showing the relationship between the slit position of the belt-like material and the analog card input voltage in the belt-like material absorbing and feeding apparatus on the side of the winding apparatus of FIG. 8.

FIG. 9 is a graph showing the relationship between the slit position where the lowest end portion of chip paper 1 is positioned and the voltage value amplified by the amplifier 61, that is, the analog card input voltage.

The analog card 62 converts the analog card input voltage, which has the non-linear relationship with the slit position of FIG. 9, to a linear voltage value to be output. The following will explain the step of such a conversion.

Figure 10:
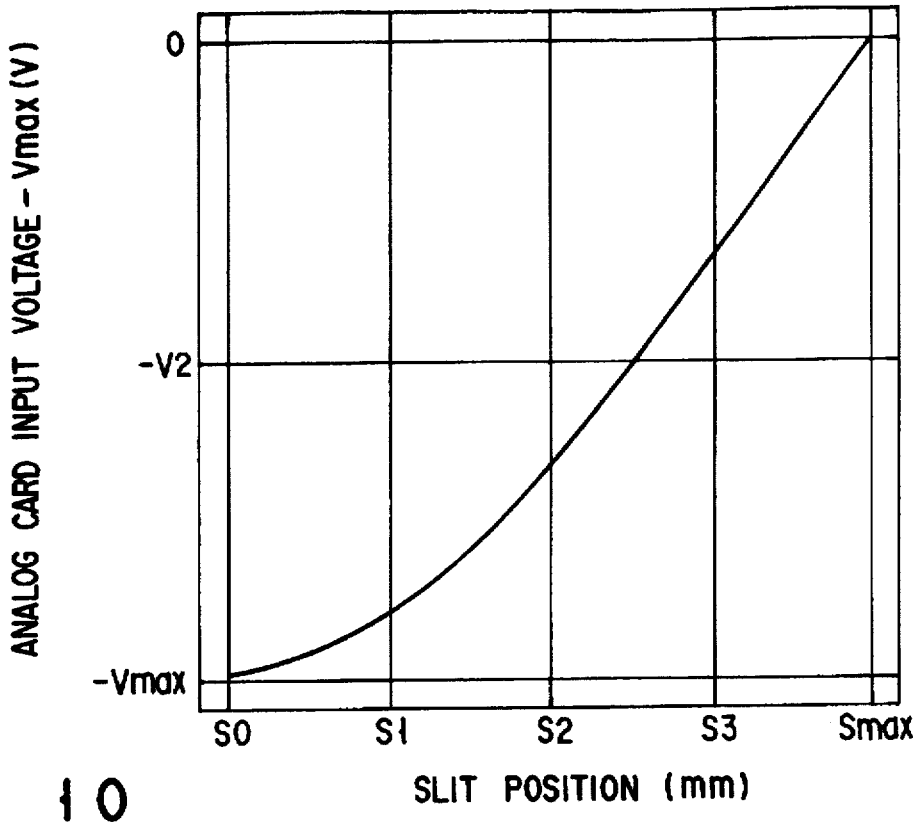
FIG. 10 is a graph showing that experimental data of FIG. 9 is converted to the relationship between the slit position and (the analog card input voltage−Vmax)

FIG. 10 is a graph showing that experimental data of FIG. 9 is converted to the relationship between the slit position and the analog card input voltage–Vmax.

Figure 11:
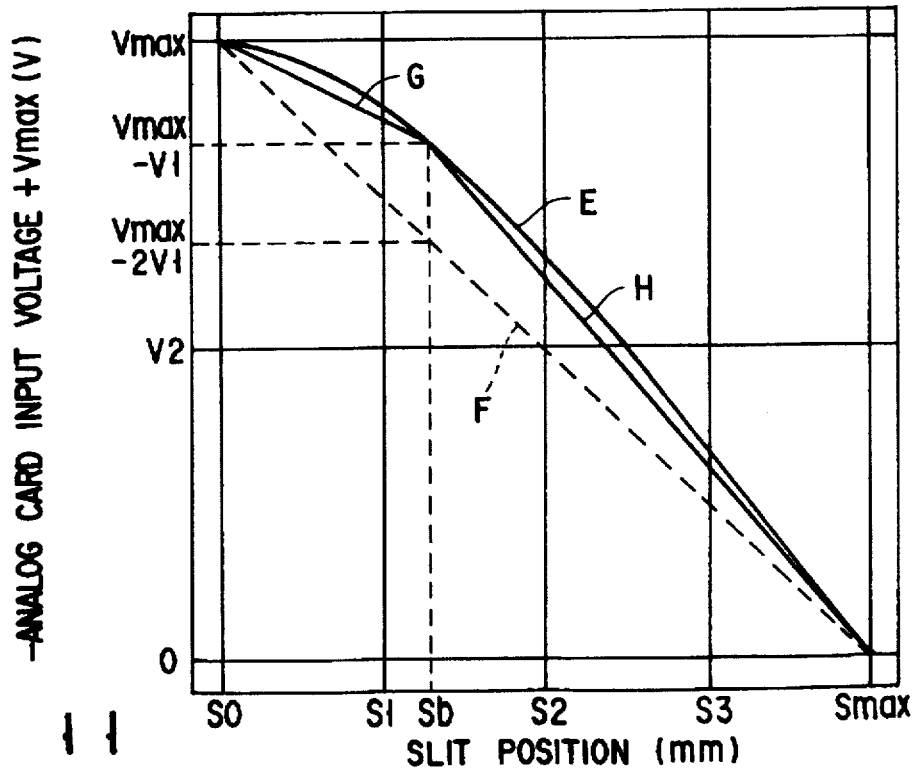
FIG. 11 is a graph showing that the graph of FIG. 10 is converted to the relationship between the slit position and (the analog card input voltage+Vmax)

A polarity of the analog card input voltage–Vmax of FIG. 10 is inverted, so that–analog card input voltage+Vmax corresponding to the slit position is output. FIG. 11 is a graph showing that the graph of FIG. 10 is converted to the relationship between the slit position and the–analog card input voltage+Vmax. In FIG. 11, in order to convert the non-linear function E showing the relationship between the slit position and–analog card input voltage+Vmax to the linear function F, the non-linear function E is approximated by two straight lines G and H. Then, the analog card input voltage at the cross point between two approximate straight lines G and H is corrected to correspond to the analog card input voltage of the linear function F at the same slit position Sb. In this embodiment, the analog card input voltage (Vmax−V1) at the cross point between two approximate straight lines G and H is corrected to correspond to the analog card input voltage (Vmax−2V1) of the linear function F at the same slit position Sb.

Figure 12:
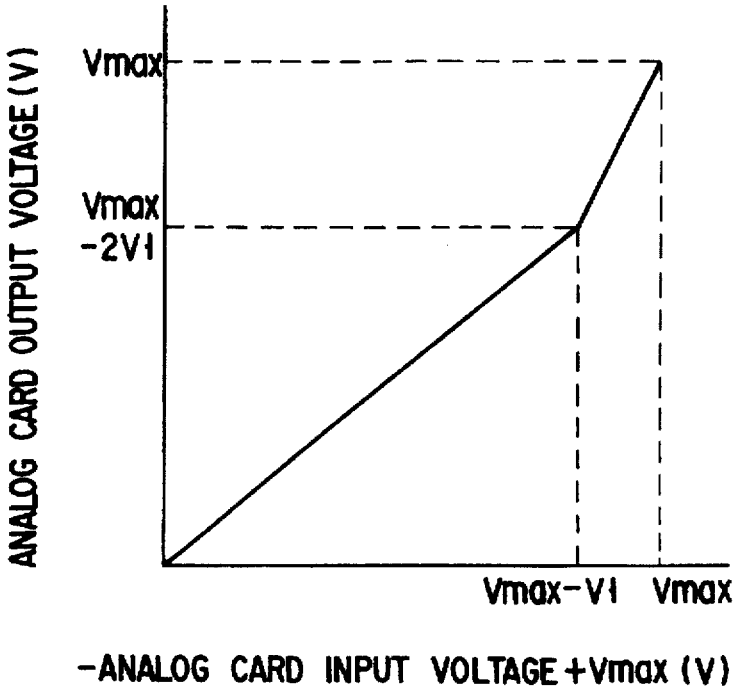
FIG. 12 is a graph showing the relationship between (−analog card input voltage+Vmax) and the analog card output voltage.

FIG. 12 is a graph showing the relationship between−analog card input voltage+Vmax and the analog card output voltage, which is corrected by an analog card 62 so as to be output to a servo driver 63. The analog card input voltage is converted to the analog card output voltage based on the relationship of FIG. 12.

Figure 13:
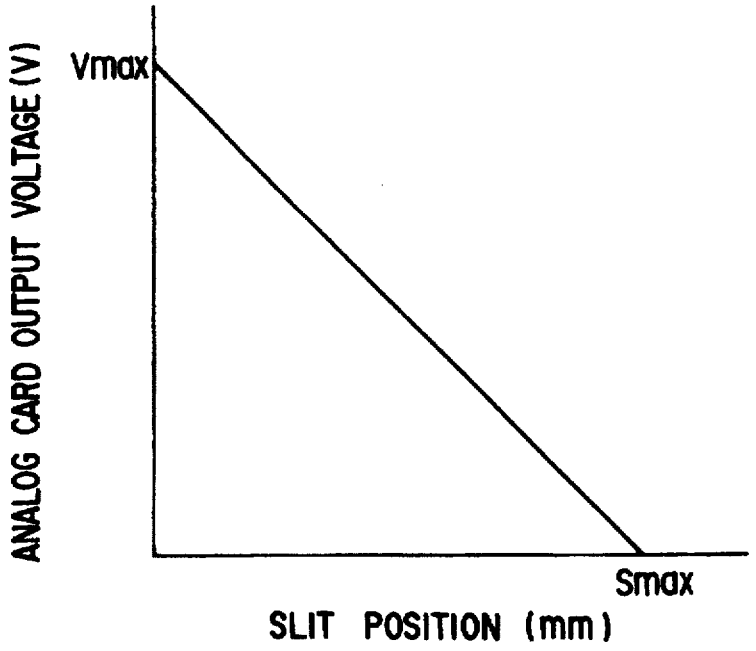
FIG. 13 is a graph showing the corrected relationship between the slit position and the analog card output voltage on the side of the winding apparatus.

FIG. 13 is a graph showing the corrected relationship between the slit position of chip paper and the analog card output voltage. As shown in FIG. 13, the analog card output voltage corresponding to the slit position of chip paper is converted to the linear function.

As mentioned above, the analog card input voltage, which has the non-linear relationship with the slit position of chip paper absorbed and fed to the reserving chamber, is approximated by two straight lines after the analog card input voltage is converted to the voltage−Vmax and the polarity of the voltage is inverted. Moreover, the analog card input voltage is corrected based on the relationship of FIG. 12. As a result, two approximate straight lines is converted to one linear function F, so that the analog card output voltage corresponding to the slit position can be obtained as shown in FIG. 13. The voltage output from the analog card 62 is input to the servo driver 63 for driving the servo motor 35. In accordance with the analog card output voltage, the rotating speed of the servo motor 35 is controlled. Then, the winding roller 34 is rotated at a predetermined rotating speed in accordance with the rotating speed of the servo motor 35, so that chip paper 1 is wound around the winding bobbin.

In other words, if the amount of absorbing and feeding the chip paper 1 in the reserving chamber is large, that is, the slit position of chip paper 1 is low, the analog card output voltage is increased, and the rotating speed of the servo motor 35 is increased. Therefore, the amount of winding chip paper 1, which is wound by the winding roller 34, is increased. As a result, the slit position rises. On the other hand, if the amount of absorbing and feeding chip paper 1 is small, that is, the slit position of chip paper 1 is high, the analog card output voltage is decreased, and the rotating speed of the servo motor 35 is reduced. Therefore, the amount of winding of chip paper 1, which is wound by the winding roller 34, is decreased. As a result, the slit position is lowered.

In the above-mentioned control system, the rotating speed of the winding roller 34 can be controlled in accordance with the amount of absorbing and feeding chip paper 1 in the reserving chamber regardless of the diameter of the roll of the winding roller 34 by which chip paper is wound. Moreover, the apparatus can be instantaneously started and stopped without applying high load to chip paper 1, and the feed roller 31.

The use of the apparatus for stably transferring belt-like material of the present invention is not limited to the punching apparatus for forming fine holes in rolled chip paper. The present invention can be applied to the supplying apparatus or the winding apparatus, independently. Moreover, the present invention can be applied to the apparatus for printing or processing the other belt-like material, e.g., wrapping paper.

As explained above, the apparatus for stably transferring belt-like material of the present invention comprises the absorbing and feeding apparatus for continuously absorbing and feeding the belt-like material in the transferring passage where the belt-like material is transferred. The absorbing and feeding apparatus comprises the reserving chamber for absorbing and feeding the belt-like material to be reserved therein, and the pressure detecting chamber connected to the reserving chamber through the slit or the through hole. The reserving chamber has the opening portion for absorbing and feeding the belt-like material, and the blower is connected to at the position, which is opposite to the opening portion. If the blower absorbs the internal air of the reserving chamber, negative pressure is applied to the belt-like material to be passed through the opening portion, so that the belt-like material is absorbed and fed to the reserving chamber. The pressure detecting chamber is closed such that pressure of the pressure detecting chamber is changed in accordance with the change of the pressure in the reserving chamber connected to the pressure detecting chamber through the through hole. The pressure of the pressure detecting chamber is detected by the pressure detector. The pressure of the reserving chamber is changed in accordance with the amount of absorbing and feeding the belt-like material absorbed and fed in the reserving chamber. Due to this, the lowermost end position of the absorbed and fed belt-like material can be correctly detected by detecting the internal pressure of the pressure detecting chamber.

Moreover, based on the detection result, the amount of supplying the belt-like material of the supplying apparatus or that of winding the belt-like material of the winding apparatus can be controlled. In other words, in accordance with the lowermost end position of the belt-like material absorbed and fed in the reserving chamber, the drive voltage of the servo motor for driving the delivery roller or the winding roller is controlled, and the rotating speed of each roller is controlled. Therefore, the amount of supplying the belt-like material of the supplying apparatus or that of winding the belt-like material of the winding apparatus can be appropriately controlled.

Furthermore, in the apparatus for processing the transferring belt-like material, the belt-like material is reserved to the reserving chamber of the absorbing and feeding apparatus, which is provided in the transferring passage, by use of negative pressure before the operation of the apparatus is started. Therefore, even in a case where the belt-like material is instantaneously transferred at the time of starting the apparatus, the load to be applied to the belt-like material can be relaxed by the reserved belt-like material. Due to this, the belt-like material can be prevented from being broken at the time of starting the apparatus. Also, even after the belt-like material is started to be transferred, the belt-like material is reserved in the reserving chamber at substantially the fixed rate. Due to this, load is little applied to the feed roller and the belt-like material itself when the belt-like material is transferring or the operation of the apparatus is stopped. Also, the belt-like material is prevented from being broken when the belt-like material is transferring or the operation of the apparatus is stopped.

Therefore, there can be provided an apparatus for stably transferring belt-like material, which can be instantaneously started at high speed and stopped. Also, a stable transfer of the belt-like material can be ensured. Due to this, the apparatus can be prevented from being undesirably stopped by the breakage of the belt-like material, so that ability of processing the belt-like material can be improved.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An apparatus for stably transferring belt material comprising:

transferring means for transferring belt material;

absorbing and feeding means, having a reserving chamber for reserving said transferred belt material, for applying a pressure difference to first and second spaces of said reserving chamber divided by said transferred belt material so as to absorb and feed said belt material to said reserving chamber;

detecting means for detecting an extending position of said belt material moving up or down in said reserving chamber;

controlling means for controlling said transferring means in accordance with an output detected by said detecting means so as to adjust a transferring speed of said belt material; and processing means for forming fine holes in said belt material.

2. The apparatus according to claim 1, wherein said detecting means includes pressure detecting means for detecting the pressure difference between said first and second spaces so as to obtain the belt material extending position.

3. The apparatus according to claim 1, wherein said absorbing and feeding means includes absorbing mechanisms for absorbing said belt material.

4. The apparatus according to claim 1, wherein said transferring means includes a roller mechanism for supplying said belt material, and tension applying mechanisms for applying to said belt material.

5. The apparatus according to claim 1, wherein said transferring means includes a delivery roller mechanism for delivering the belt material and a winding roller mechanism for winding the belt material passed through said absorbing and feeding means, and at least one of said delivery roller mechanism and said winding roller mechanism is controlled by said controlling means.

6. An apparatus for stably transferring belt material comprising:

supplying means for supplying belt material;

first absorbing and feeding means having a reserving chamber for continuously absorbing and feeding said belt material supplied from said supplying means, and a pressure detecting chamber, provided at the back of said reserving chamber through a through hole, and closed to detect its internal pressure;

transferring means for pulling out said belt material absorbed and fed to the reserving chamber of said first absorbing and feeding means so a to be transferred;

first pressure converting means, connected to said pressure detecting chamber of said first absorbing and feeding means, for detecting the internal pressure of said pressure detecting chamber changing in accordance with the amount of absorbing and feeding belt material absorbed and fed to said reserving chamber so as to convert said detected internal pressure to an electrical signal;

supply controlling means for controlling the amount of supply of the belt material supplied by supplying means based on the electrical signal converted by said first pressure converting means;

second absorbing and feeding means having a reserving chamber for continuously absorbing and feeding said belt material transferred from said transferring means, and a pressure detecting chamber, provided at the back of said reserving chamber through a through hole, and closed to detect its internal pressure;

receiving means for receiving said belt material transferred to said reserving chamber of said second absorbing and feeding means;

second pressure converting means, connected to said pressure detecting chamber of said second absorbing and feeding means, for detecting the internal pressure of said pressure detecting chamber changing in accordance with the amount of absorbing and feeding the belt material absorbed and fed to said reserving chamber so as to convert said detected internal pressure to an electrical signal; and receiving controlling means for controlling the amount of receiving of the belt material received from said receiving means based on the electrical signal converted by said second pressure converting means.

7. The apparatus according to claim 6, further comprising processing means for processing said belt material pulled out of said first absorbing and feeding means and transferred by said transferring means.

8. The apparatus according to claim 6 further comprising processing means for forming a fine hole on said belt material transferred by said transferring means, wherein said belt material is chip paper for cigarettes.

9. The apparatus according to claim 6, wherein said supplying means has a rotational shaft for loading a rolled belt material, and said rotational shaft is rotated, thereby supplying said belt material.

10. The apparatus of according to claim 6, wherein said receiving means has a rotational shaft for winding a rolled belt material, and said rotational shaft is rotated, thereby winding said belt material.

* * * * *